United States Patent [19]

Sciortino

[11] 4,359,184

[45] Nov. 16, 1982

[54] SELF-LOCKING COIN RECEPTACLE AND COVER THEREFOR

[76] Inventor: August M. Sciortino, 1838 Weeg Way, Park Ridge, Ill. 60068

[21] Appl. No.: 136,889

[22] Filed: Apr. 3, 1980

[51] Int. Cl.[3] ..... G07B 15/00

[52] U.S. Cl. ..... 232/16

[58] Field of Search ..... 232/15, 16, 31, 32, 232/1

[56] References Cited

U.S. PATENT DOCUMENTS

| | | | |
|---|---|---|---|
| 2,973,139 | 2/1961 | Leone et al. | 232/15 |
| 3,433,185 | 3/1969 | Roberts | 232/15 X |
| 3,797,735 | 3/1974 | Sciortino | 232/16 |
| 3,843,043 | 10/1974 | Sciortino | 232/15 |
| 3,926,366 | 12/1975 | Sciortino | 232/16 |
| 4,177,920 | 12/1979 | Sciortino | 232/16 |

*Primary Examiner*—Roy D. Frazier
*Assistant Examiner*—Peter A. Aschenbrenner
*Attorney, Agent, or Firm*—Silverman, Cass & Singer, Ltd.

[57] ABSTRACT

A self-locking coin receptacle and cover therefor for use in coin-controlled machines. The cover is formed of two parts, the first being a rectangular open-bottom channeled member carrying a window and a second, channeled member carrying an open-topped flexible bag aligned with the window. The second member is adapted slidably to receive the first member telescopically therein. A spring biased slide is installed on the floor of the channel defined within said first member and operates between a first condition covering the window and a second condition uncovering the window. A band spring member removably is fastened to the first member and includes a bent formation at its free end arranged to ride the slide when the same is moved to uncover the window, and to block movement of the slide when the window is covered by return of said slide. A spring biased blade is pivotally mounted to the slide for movement therewith when the slide is moved to uncover the window. The blade mounted to pivot when engaged by said slide during the retromovement thereof after fully uncovering the window to again cover the same. The bent formation drops off the slide and engages the leading edge of the slide, biased thereagainst by the spring biased blade whereby to prevent subsequent movement of the slide. When the mechanism is reset for operation, the bent formation of the spring is lifted by grasping a tab provided thereon, the spring biased blade returning immediately to its normal position, since the latch is lifted from its engagement with the trailing edge of the slide. When the latch end is lifted, it rests upon the blade, the slide is actuated again, the bent formation is guided over and past the trailing edge of the blade onto the slide. A spring biased detent is positioned to enter the window whenever the window is uncovered, fully or partially and remains in the window to prevent removal of the bag and cover from its installation unless the window again is covered simultaneously with removal from said installation.

16 Claims, 13 Drawing Figures

SELF-LOCKING COIN RECEPTACLE AND COVER THEREFOR

CROSS REFERENCE TO RELATED PATENTS

This application relates to improvements over the subject matter disclosed in U.S. Pat. No. 4,177,920 granted Dec. 11, 1979 and owned by the applicant herein.

BACKGROUND OF THE INVENTION

This invention relates generally to locking covers for coin containers of the type used with coin-controlled machines, and provides a self-locking cover for such containers, the cover having means installed therein to prevent non-detectable tampering with the container by servicemen or others during the period between removal from the coin-controlled machine and deposit at an authorized counting station.

Vending machines operated by coins normally have coin containers such as coin boxes or similar receptacles to receive the coins dropped into the machine by those who have purchased merchandise from the machines. Such coin containers are locked into prefabricated recesses provided in the machines. When the machine is serviced, the serviceman removes the loaded coin container, empties it and replaces it within the recess.

For security purposes it has become customary to have a coin container which is locked, and remains locked until it is returned to the proprietor of the vending machine or to an authorized counting station whereat it can be opened and the coins removed. In such cases, the serviceman is provided with an empty, locked container so that when the loaded container is removed from the enclosure, a fresh, empty container replacement can be installed.

In order to prevent pilferage from the coin container subsequent to removal from the machine, the serviceman is not given keys thereto. Accordingly, the container must have a mechanism to meet the following conditions:

The coin container must be in condition to receive the coins when the serviceman installs the same within the enclosure provided in the machine. Normally there is a window in the top of the container which must be opened on installation and remain open after the container is installed, the window being aligned with the delivery end of the coin chute of the machine. This window must be closed at all times when the container is outside the enclosure. When the serviceman removes the loaded container, his act of removal must close the window, lock it in closed condition and must thwart any attempts to gain access to the interior thereof for the surreptitious non-detectable removal of coins therefrom.

Apparatus of the general type is known; reference may be made to U.S. Pat. Nos. 2,973,139; 1,685,219; 2,580,752 as well as to Applicant's prior U.S. Pat. Nos. 3,797,735 and 3,843,043.

A significant cash loss from vending machine collections still remains a persistent problem to which much attention presently is directed. Some proposed solutions are without sufficient economic feasibility to gain wide acceptance. One source of loss involves internal cash security in view of the numerous individuals who handle the coin boxes including route men handling the particular installations, route supervisors, mechanical supervisors, internal auditing personnel and others.

Inevitably, no matter how many locks, tamperproof devices, etc. are installed, the very strength of the temptation for undetected pilfering gives rise, in a clever and/or unscrupulous individual, to ingenious means for "beating" the protective devices which have been provided. Although the provision of a machine that is "unbeatable" probably is not possible, the provision of means to effect positive detection of tampering, if tampered, to provide identification of the fact and possibly the culprit is highly desirable.

Prevention of undetectable, surreptitious entry to the coin containers whether prior to installation in a machine, during and in the period subsequent to removal thereof by the serviceman until deposit of the locked boxes in secure areas with those who are empowered to open the boxes and tally the contents thereof is a very important goal.

In view of the individuality of many of the coin-controlled machines and substantial difference in construction between machines of different manufacturers, another important criteria which must be met by any proposed protective device in order to gain acceptance, in addition to being "tamperproof", is that the device be capable for use with different machines without major fitting adjustments, be easily transportable with security, relatively simple to construct, to assemble for the serviceman to install and others to handle opening, resetting and locking. The structure must render non-detectable tampering highly improbable and, at best, should be provided with some type means to prevent unauthorized access thereto even while installed within the machine.

Of course, minimization of the total number of required parts lead to reduction in cost and complexity of manufacture and assembly. Accordingly, proposed solutions to the problem of undetected tampering, etc. should meet such criteria.

Much attention also has been directed to providing locked coin bags for use in vending machines. Of advantage is the ease of transport with security since the loaded bag will be receivable in drum type safes or other secure repositories with minimum bulk space requirement. Thus, the self-locking cover should be suitable for use with coin bags.

Structure also should be provided to enable the locked coin receptable to be unloaded, removed from the vending machine, transported with security, unlocked, unloaded, reset and readied for installation with minimum complexity and time lapse.

Also advantageous would be the provision of means whereby the act of installation by the serviceman must be completed, so that if interrupted, completion would be prevented and a new locked receptacle would be required.

The invention herein particularly is directed to the provision of a self-locking cover for a coin receptacle for coin-controlled machines, the cover having spring-biased locking and resetting means improved over the locking and resetting means disclosed in my earlier pending patent application referenced herein.

In U.S. Pat. No. 4,177,920 granted Dec. 11, 1979, there was described a flexible bag coin container and self-locking cover therefor which assembly is slidably received within a bracket coupled to the coin funnel installed interior of the conventional enclosure into which coins, introduced by purchasers, pass from the delivery end of the coin chute of the machine. The cover includes an access window and spring-biased means are provided for selectively for uncovering the window, and maintaining the window open when installed, and covering the window automatically during withdrawal of the container subsequent to installation. Means also were provided to prevent unauthorized and undetectable access to the interior of the coin container during its transit to a coin collecting and counting station remote from the machine installation.

The earlier self-locking cover disclosed detent means effective to prevent withdrawal of the covered container from the coin controlled machine unless the access window of the cover was blocked; and spring-biased catch means functioning to prevent subsequent uncovering of the access window.

The improved structure herein presented provides a self locking mechanism which is simple to operate, to fabricate, to install and to service.

BRIEF SUMMARY OF THE INVENTION

The invention provides a self-locking cover assembly for a coin container. The cover includes a first channel member open at one end. A slide is arranged in the channel. A second channel member carrying a flexible coin bag is capable of receiving the first channel member to complete the cover assembly. A window is formed in the top wall of the first channel member. The window is located to enable alignment with the delivery end of the coin chute of the coin-controlled machine when the bag and locked cover assembly is installed fully into the machine. The slide is movable during entry into the enclosure between a condition whereat the window is blocked to a condition in which the window is open. Means are provided to maintain the open condition subsequent to installation and to retain the open condition thereof while the container remains installed. Means also are provided whereby during and subsequent to the withdrawal of the coin box from the enclosure, the window is blocked and access may not be gained thereto by covert or surrepititious action. In particular, spring means are employed ridable on the slide during uncovering of the window and upon withdrawal against the one edge of the slide to prevent access to be gained to the window. Once installed within the designated enclosure, the locked assembly cannot be withdrawn unless the window is closed off. Once the container is withdrawn, the window cannot be uncovered covertly without detection. Means also are provided to prevent withdrawal of the locked container from the enclosure area so long as the window is even partially uncovered, and to prevent return of the container once it has been removed unless the locking means have been re-set.

DESCRIPTION OF PREFERRED EMBODIMENTS

Figure 1:
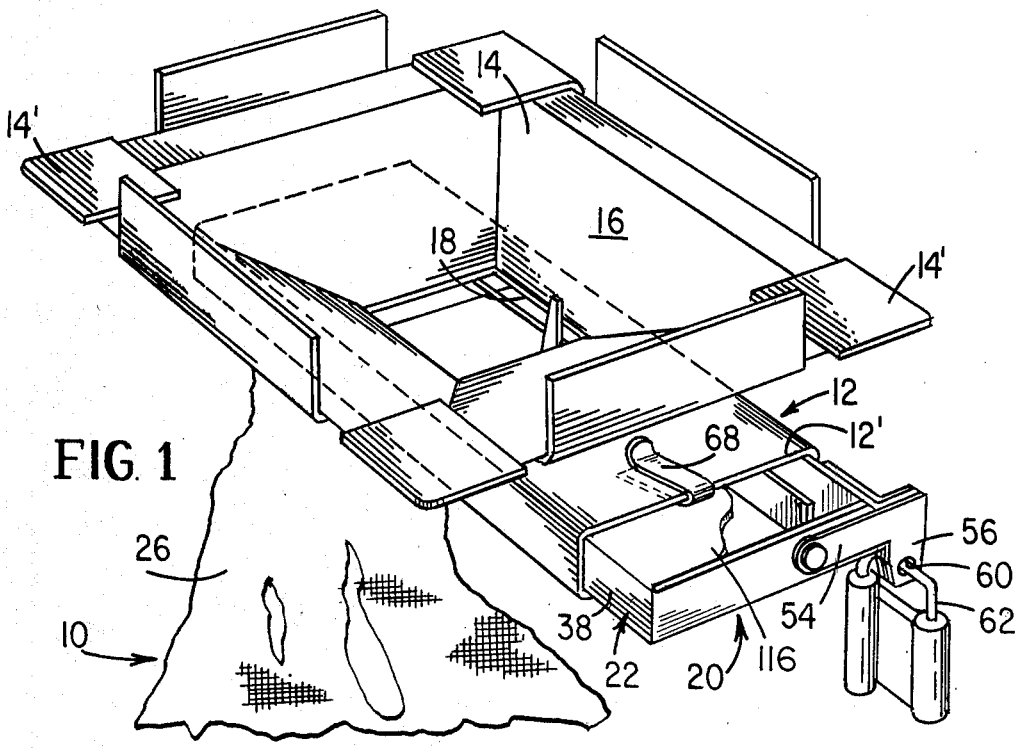
FIG. 1 is a perspective view, looking downward, of a locked covered coin receptacle bag according to the invention as installed in a preformed bracket structure capable of being secured within an enclosure formed in a conventional coin controlled machine.
Figure 2:
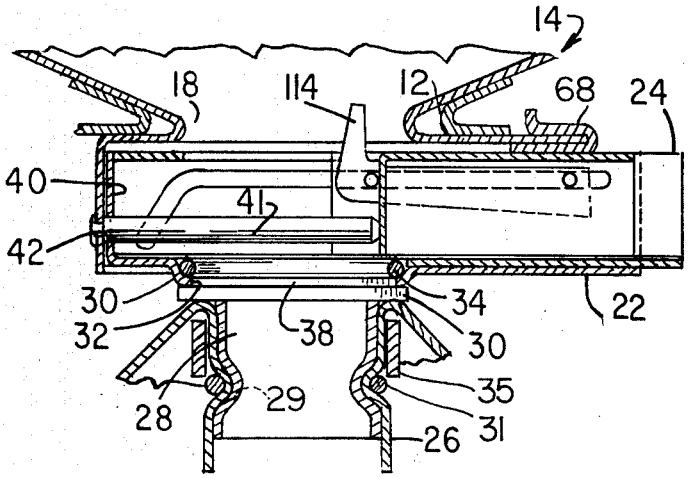
FIG. 2 is a fragmentary sectional view of the bracket and self-locking covered coin receptacle bag according to the invention as illustrated in FIG. 1
Figure 3:
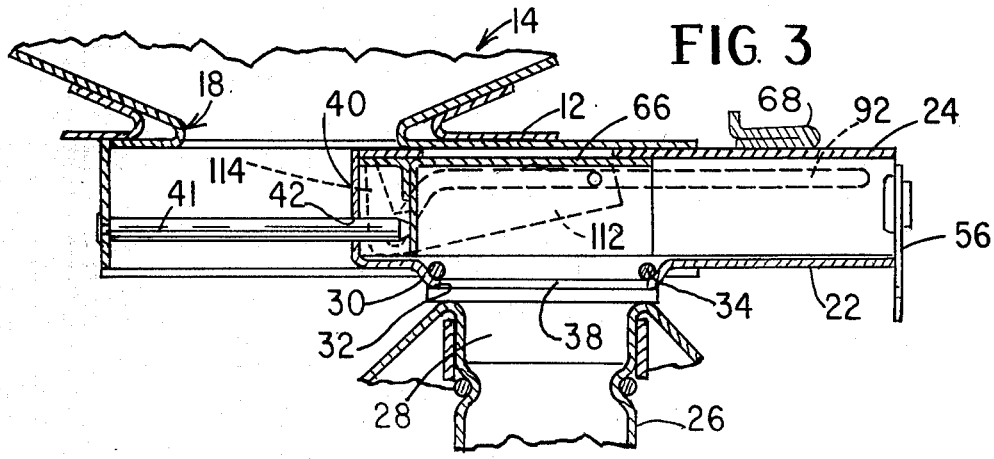
FIG. 3 is a fragmentary sectional view of the bracket and self-locking covered coin receptacle according to the invention illustrated in the condition assumed thereby during withdrawal of said covered coin receptacle from the bracket of FIG. 1.
Figure 4:
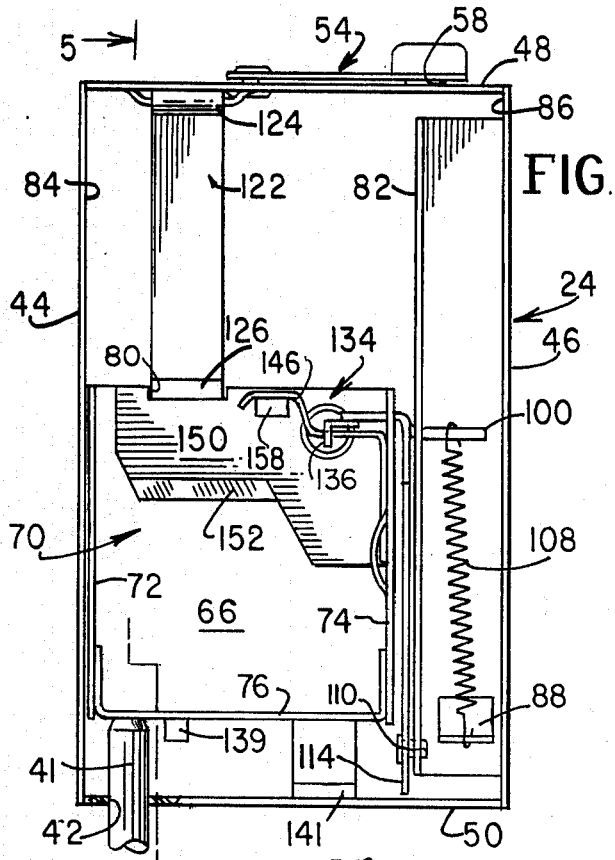
FIG. 4 is a plan view of a portion of the cover constructed in accordance with the invention, said covered portion carrying the self-locking mechanism and shown in the primed or cocked (reset) condition assumed prior to installation in the bracket of FIG. 1.
Figure 5:
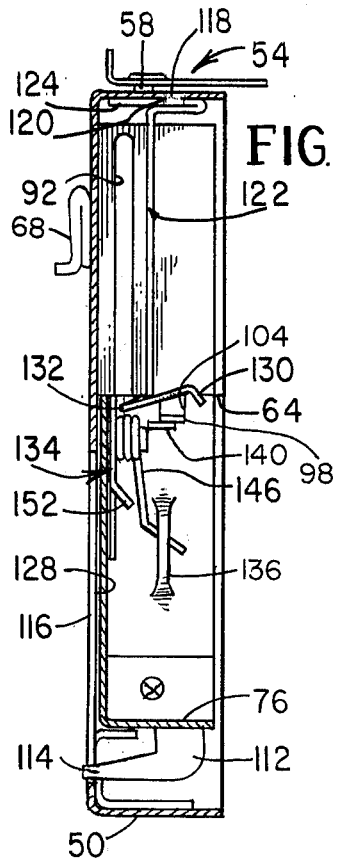
FIG. 5 is a longitudinal sectional view taken along lines 5—5 of FIG. 4 and in the direction indicated.
Figure 6:
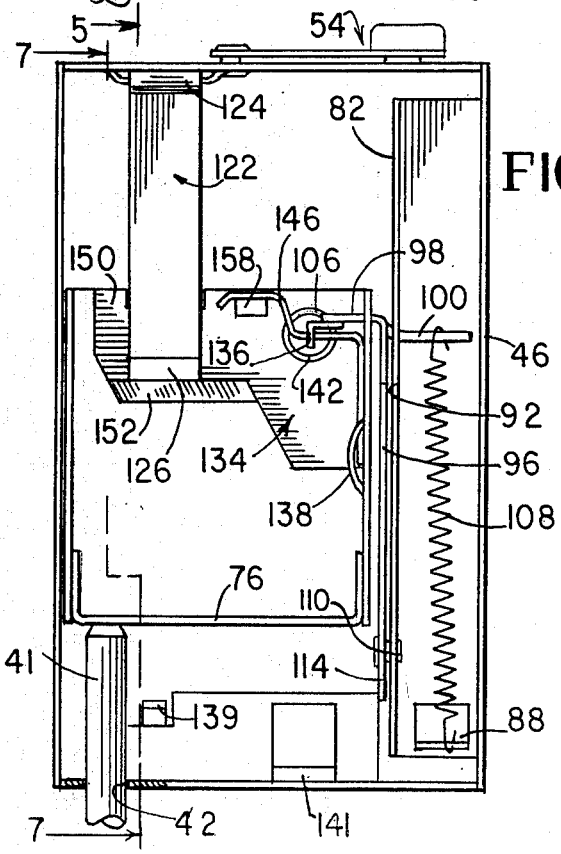
FIG. 6 is a plan view similar to that of FIG. 4 but illustrating the condition of the self-locking mechanism during installation of the covered coin receptacle into the bracket of FIG. 1.
Figure 7:
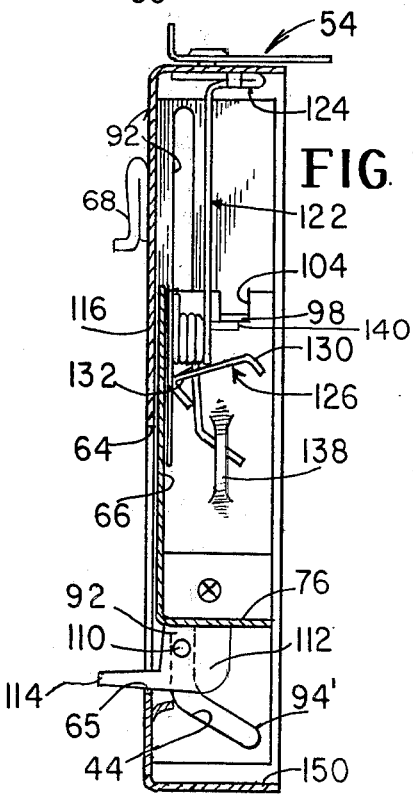
FIG. 7 is a longitudinal sectional view taken along lines 7—7 of FIG. 6 and in the direction indicated.
Figure 8:
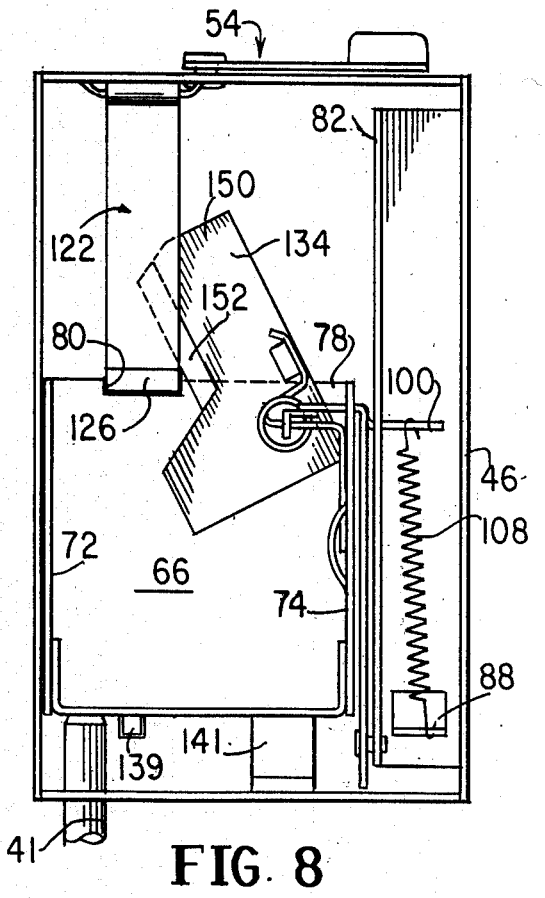
FIG. 8 is a plan view similar to those of FIGS. 4 and 6, but illustrating the condition of the self-locking mechanism subsequent to withdrawal of the covered coin receptacle from the installation illustrated in FIG. 1.
Figure 9:
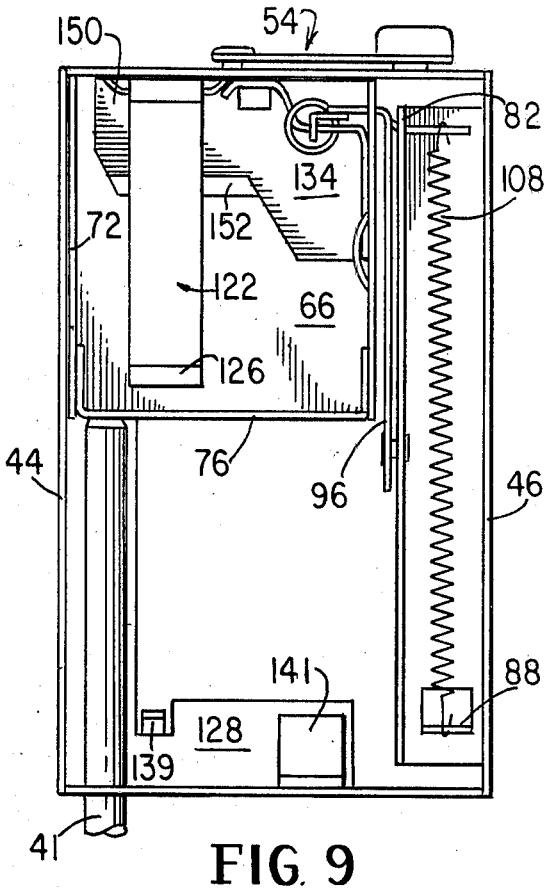
FIG. 9 is a view similar to that of FIGS. 4, 6 and 8 but illustrating the condition of the locking mechanism assumed when fully installed within the bracket of FIG. 1.
Figure 10:
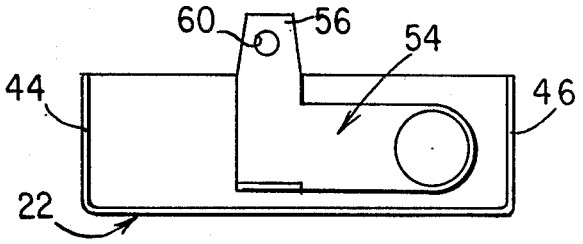
FIG. 10 is an end view of the installed cover showing the sealing means, the broken line representation illustrating means employed to secure the cover portions together in assembled condition.

The invention herein includes, in common with the devices disclosed in the referenced patent, the provision of a spring biased slide biased normally to block the window of the cover through which coins enter the receptacle when same is installed. A cammed detent extends into the window when the slide is displaced against its normal bias during installation of the covered coin receptacle into the coin machine. The detent cooperates with the coin chute of the machine or its equivalent to block the removal of the covered receptacle from the machine unless the aforementioned window is blocked fully by the slide, return movement of the slide normally causing the detent to be retracted.

The differences between the devices disclosed in the referenced patent and the instant device comprise the provision of a band spring preferably having one end secured removably to the cover. The band spring has a bent formation at its free end biased to ride the slide during displacement of said slide. The herein invention also provides a spring biased plate or blade mounted on the slide for pivotal movement in a plane parallel to the slide surface. The blade is carried by the slide. A notch is formed in the slide at one edge thereof and at a location on the slide aligned with the bent formation of the band spring when same is installed in the cover.

The blade normally is interposed between said bent formation and the notch. The blade has an upwardly angled edge formation. When the slide uncovers the window, the bent formation first rides the surface of the blade, then drops to the slide surface. The slide and blade travel together during opening of the window. When the window is open fully, the blade is disposed rearward of the bent formation carried on the slide by pivoting about its mounting.

When withdrawal of the covered coin receptacle is effected, say for replacement of a coin-filled receptacle for a fresh one, the covered receptacle is drawn from its installation. As withdrawal is initiated, the slide is released to resume its normal condition, covering the window. Simultaneously, the detent is cammed to retract the same, such retraction not being completed until the slide has been translated sufficiently to cover the window.

As the slide moves to a position assumed with the window covered fully, the angled formation on the blade engages the bent formation of the band spring. Since the slide is return translated, it continues to move toward the condition assumed thereby when the window is covered fully. The angled formation or upset of the blade is intercepted by the bent formation of the band spring. The movement of the blade is retarded with the same being forced from its otherwise shielding condition relative to the notch carried by the slide. The blade pivots and remains behind or rearward of the bent formation but bears thereagainst. The bent formation thus rides only the slide; the said bent formation then falling off the slide to engage the floor of the cover and enter the notch, bearing against said floor. The blade now pivoted against its normal biased condition, bears against the rear of the bent formation, forcing same against the edge of the slide so long as the bent formation is disposed within the notch. Accordingly, movement of the slide in a direction required again to uncover the window is prevented.

When the locked covered coin receptacle is deposited at a depository where an exterior seal is broken, the cover portions are separated, the bag emptied of coins and the coins counted or otherwise tabulated. Before the cover portions are reassembled, the lock mechanism must be primed (cocked or reset).

The bent formation of the band spring can be lifted and the blade released to interpose itself between the bent formation and the slide, simultaneously lifting the bent formation from the notch. Now the mechanism is effectively reset and the cover portions can be assembled to define a fresh receptacle ready for installation anew.

The provision of the pivotable blade positively prevents tape or any other objects from effectively neutralizing the self-locking feature of the cover. The resetting capability of the herein proposed structure is improved because of ease of handling same to effect such resetting.

It should be pointed out that the deterrence afforded by the invention is against serreptitions pilfering or tampering, that is without leaving evidence thereof for detection. Of course, if a thief desires to gain unauthorized access to the receptacle for the purpose of a theft, he can slash the bag or apply force to the cover sufficient to gain access thereto. Obviously, immediate recognition is gained of the event because of the visible and obvious damage to the receptacle and/or cover.

Now looking at the drawing, the receptacle carrying the cover to which is attached the cover of the invention is designated by reference character 10 with the assembled cover designated by reference character 20.

Many of the features and advantages of the herein improvement are common with the referenced patent.

Referring now to the drawing, in FIG. 1, et seq., a locked, covered flexible coin bag assembly 10 is illustrated installed within channel-shaped bracket 12, shown secured to a coin funnel 14. The funnel 14 is installed via tabs 14' within a conventional coin-receiving housing (not shown) fabricated in a coin-operated machine. Coins land onto one of the tapered walls 16 of funnel 14 and are directed to the bottom opening 18. Plural tabs 14' provide for universal installation capability.

The receptacle 10 is provided with container cover 20 formed of a pair of channeled members 22 and 24 of generally rectangular configuration, and a flexible, open-topped bag 26 formed of plastic or cloth material secured onto one of said members.

The bag 26 is provided with a collar 28 having an undercut rim 30 capable of being received within the circular rimmed opening 32 formed in the member 22. The opening 32 is located for alignment with the bottom opening 18 of the funnel 14 when the assembly 10 is installed within channeled bracket 12. The rim 30 is locked in place by a split retaining ring 34 seated on rim 30' surrounding opening 32 and within circumferential groove 38 formed on rim 30 defining a swivel coupling.

The bag 26 is secured to the collar 28 so as to resist separation when installed. The manner of securing the bag 26 to collar 28 is described in the patent. The collar 28 has a circumferential groove 29 and is placed within the upper open end of the bag 30. A split retaining ring 31 is spread slightly fitted over the open end of bag 30 and released to seat in groove 29 sandwiching the bag 30 therebetween. A flat security ring 35 is secured tightly about the bag 30 above ring 31 and the bag 30 is draped over ring 35.

Cover portion 22 includes a pair of parallel side walls 38 and an end wall 40, the same having an aperture 42 formed therein. The side and end walls 38 and 40 have right angle flanges 38 and 40. Means such as a bar 41 are provided within bracket 12 to drive the slide during installation. Flanges 38 and 40 define a track.

The cover portion 24 holds the operating mechanisms of the cover 20 and includes a pair of parallel side walls 44 and 46 and end walls 48 and 50 defining a chamber 52. A latch 54 including hook 56 is secured to the end wall 48. The cover portion 22 carries a slot 58 located to receive the hook 56 when the portion 24 is fully received telescopically in portion 22. The latch 54 is rotatable into and out from slot 58. The latch 54 also carries an aperture 60 located at the free end thereof and a plastic locking seal 62 can be passed therethrough after the latch 54 is manipulated to feed hook 56 through slot 58. Once seal 62 is applied and locked, severance is required to remove the seal and gain access to the interior of assembly 10. This cannot be performed surreptitiously without observable detection.

The cover portion 24 has a window 64 as well as a longitudinal slot 65 opening to one corner of window 64. A return bent spring clip 68, opening to the open end of the cover portion 24, fixedly is secured to the outer surface of wall 116 of cover portion 24 and functions as a stop and retainer when the assembly 10 is introduced into the bracket 12 below the funnel 14. In FIG. 1, a portion of wall 116 is broken away.

A spring-biased slide assembly 70 is arranged within the cover portion 24 for covering and uncovering the window 64. The slide assembly includes a flat slide 66 having a pair of parallel side walls 72, 74 and a bridging end wall 76. Edge 78 of slide 66 has a notch 80 formed therein.

A partition 82 is secured fixedly to the cover 24 interior of chamber 52 and parallel to walls 44, 46 of cover portion 24.

The partition 82 is positioned adjacent to the window 64 and defines sub-compartments 84 and 86. An apertured tab 88 is secured to cover portion 24 parallel to and adjacent end wall 50 in sub-compartment 86. Partition 82 carries notch 90 and an elongate longitudinal slot 92. Slot 92 is straight along most of its length but includes an arcuate angular terminal slot section 94. A flat plate 96 is sandwiched between wall 74 of the slide 66 and the partition 82. A pair of angular, oppositely directed bent lugs 98 and 100 are formed at one end of plate 96 and formation 102 is formed at the other end of plate 96. Lug 98 passed through notch 104 of wall 74 and is secured to upright lug 106 which is mounted onto slide 66. The other lug 100 passes through the notch 90. Lug 100 is apertured. Expansion coil spring 108 is linked across tab 88 and lug 100.

A follower 110 is secured to the plate 96 near detent formation 12 and passes through the slot 92. Both lug 100 and follower 110 ride the slot 92. So long as follower 110 rides in the straight portion of the slot 92, the detent is urged outward of the window 64. At arcuate section 94 of the slot 92, the follower 110 is cammed therealong to initiate the retraction of the detent into the subchamber 86. When the follower 110 is at the terminal end 94' of the slot portion 94, the detent end 114 is fully retracted from the window 64. The detent end 114 first passes through the wall 116 of cover portion 24 via slot 65.

Wall 48 of cover portion 24 carries an outwardly protruding bridge 118 upset therefrom. Bridge 118 defines a slot 120. A generally flat band spring 122 having a clip portion 124 at one end and a bent formation 126 at its opposite end, removably is secured to the cover portion 24 by clipping portion 124 through slot 120 of bridge 118.

The band spring 122 is arranged parallel to the floor 128 of cover portion 24 and also is parallel to the side walls 44, 46 of said cover portion. Floor 128 is the under surface of wall 116 of said cover portion 24. The bent formation 126 includes upper and lower bends 130 and 132. The lower portion 132 of said formation 126 may be described as a catch formation and is biased to be seated in the notch 80 formed in slide 66. The band spring 122 is cantilevered toward the floor 128. The bend 132 of formation 126 normally rides the slide 66. The bend 130 serves as a mechanical purchase to enable the formation 126 to be lifted for the purpose of setting the cover to enable reinstallation thereof once the receptacle has been withdrawn from the installation, separated from the coin receptacle holding cover portion thereof and prior to reassembly of said receptacle assembly for reinstallation.

A flat "shutter" blade 134 is secured for slidable pivotable movement upon the slide 66 in a plane parallel to said slide. Wall 74 of slide 66 carries eye formation 138. An apertured lug 140 mounts coil spring 142 having one arm 144 seated in eye 138 and its arm 146 is secured to and abuts against about upstanding lug 158 carried by blade 134.

The blade 134 rides with the slide 66. Blade 134 also includes a large flat section 150 also slidable on the surface of slide 66 with pivotal movement of the blade 134. The section 150 is disposed to be intercepted between formation 132 and the slide 166 resting flat on the surface of slide 66. An upturned or angled bent formation 152 is provided along one edge of section 150 of blade 134 and functions as cam means to lift the bend 132 of formation 126, as will be explained.

Normally, the lower bent formation 132 rests upon the blade section 150. In such condition, no impediment is offered to movement of the slide 66 to uncover the window 64. When the slide 66 is caused to move to uncover the window 64, as by pin 41 passing through opening 42 in end wall 40 as the cover is forced into bracket 12, the pin 41 engages the bridging wall 76 of the slide 66 and forces the slide 66 to move against its normal bias to uncover the window 64. The slide is moved in the direction toward wall 40 of cover portion 24. The detent is cammed into slot 66 and then passes through window 64. The blade 134 and slide 166 move together. The bent formation 132 rests on the blade surface 150 and the conjointly moving slide and blade is translated past the base of said formation 132. The full opening of the window 64 is permitted with the slide and blade moved fully to the left in the Figures.

Obviously, to accomplish such movement, the bent formation must ride on the blade. It passes over the blade and drops to the slide surface.

Now, once opened, the bent formation 132 has dropped off the blade surface and rides the remaining slide surface, until it drops off said surface and engages the floor of the cover portion 24 itself. In completing the opening of the window, the slide is positioned at its extreme left hand location against the bias of spring 108 and thus is biased toward its window-covering condition.

After installation, removal of the cover from the bracket releases the slide, and under the effect of spring 108, movement to the left in the Figure is effected. As the slide 66 moves to return to said normal condition, that is, with the window 64 closed, the upturned edge 152 of the blade 134 engages the bent formation 132. The slide continues its return movement but the said formation 132 rides only the surface of the blade. The blade is pivoted about its mounting 136 until the raised formation 152 is engaged with the rear of the bent formation 132 of said band spring 122, bearing thereagainst after its pivotal movement of the blade is completed. The bent formation 132 is seated within notch 80 of the slide and is biased against the upraised edge of said slide at the notch 80. The slide 66 is blocked from further slidable movement in a direction required to expose the window 64. This effectively locks the cover with the window blocked and access to the interior of the bag is prevented.

Since non-detectable separation of the cover portions 22, 24 is prevented by the seal 62, undetected tampering cannot occur.

When the bag and its cover are transported to the proper destination and the seal removed by the properly authorized individual, the cover portions are separated. Then a new bag is installed, that is, a cover portion 22 carrying an empty bag is secured with the cover portion 24. The locking mechanism is reset by simply lifting the bent end formation 130, lifting formation 132 from the notch 80. The blade 134 is released to return fully to its normal condition with the bent formation 132 guided over the blocking edge of slide 66 by being raised by the blade during the return of said blade to its normal condition on the slide 66. The bent formation rides the blade and then drops onto the slide surface to complete its movement, with the leading edge of the blade ready to permit opening of the window.

When the assembled locked covered bag assembly 10 with the bent formation 126 in cocked or in primed condition, is slidably received in bracket 12, the free end of bar 41 passes through aperture 42 to engage the wall 76 of the slide 66. The slide 66 then is forced against the bias of spring 108 fully to uncover the window 64. As the window 64 is uncovered, bend 132 drops off slide 66. The detent end 114 is cammed through slot 65 to enter window 64 and hence be positioned in the opening 18 of funnel 14 in interferent relation to reverse movement of the covered bag 10 so long as the window 64 is open or partially open.

The cover 20 is pushed into the channeled bracket 12 until stopped by the leading edge 12' thereof engaged by the stop and retainer means embodied in spring clip 68. The spring clip 68 has sufficient strength to overcome, together with the frictional resistance of cover 20 within bracket 12, the bias of spring 108 which could otherwise urge the cover 20 from said bracket. The window 64 is uncovered and maintained in such condition. When the cover 20 is grasped, say with simultaneous grasping of clip 68 to begin to withdraw same, the slide 66 is released immediately under the impetus of spring 108, to cause its return to normal condition, i.e., window 64 covered, under the bias of spring 108. Simultaneously, the detent formation 114 is cammed out of interferent relation and within the cover 20. If one attempted to retain the window 64 open or even partially open, removal of the covered bag 10 from bracket 12 would not be possible. Since the detent formation 114 fully is retracted into the cover 20, access thereinto is not possible without resulting observable damage or leaving of traces of such tampering.

The bent formation 132 falls into notch 80 and prevents movement of the slide 66 to reopen the window until the spring 122 is reset by lifting bent formation 132 out of notch 80 subsequent to authorized opening of the container 10, releasing the blade 134.

Suitable stop formations 138, 140 are secured to floor 128.

As shown in FIG. 1, the locked coin container 10 can be serviced by a serviceman. The serviceman has been supplied with locked empty bags by his employer. The installed container 10 is withdrawn from the bracket 12, automatically resulting in release of the slide 66 to cover the window 64. A fresh locked covered bag with the bent formation 126 reset, slidably is installed in the bracket 12.

The container 10 which has been removed then is placed in a secure receptacle, such as a tumble or rotary safe. Any attempt to gain access to the content of the container by the serviceman or other unauthorized personnel will result in visible evidence of such attempt—surreptitious tampering being impossible without detection.

Figure 11:
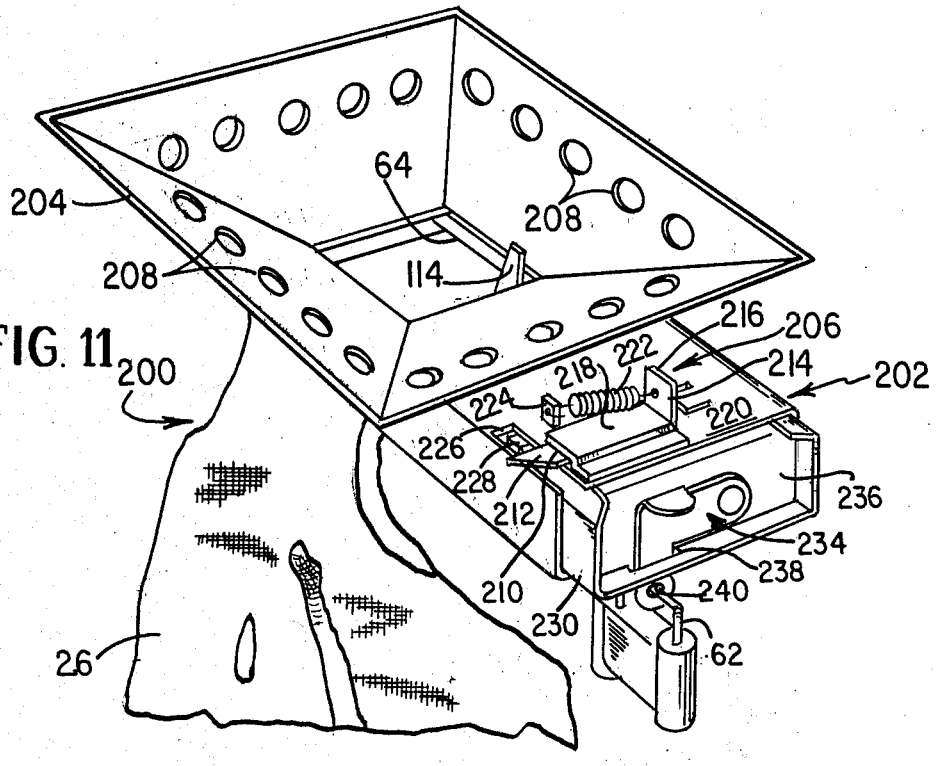
FIG. 11 is a perspective view of a modified embodiment of the invention herein.
Figure 12:
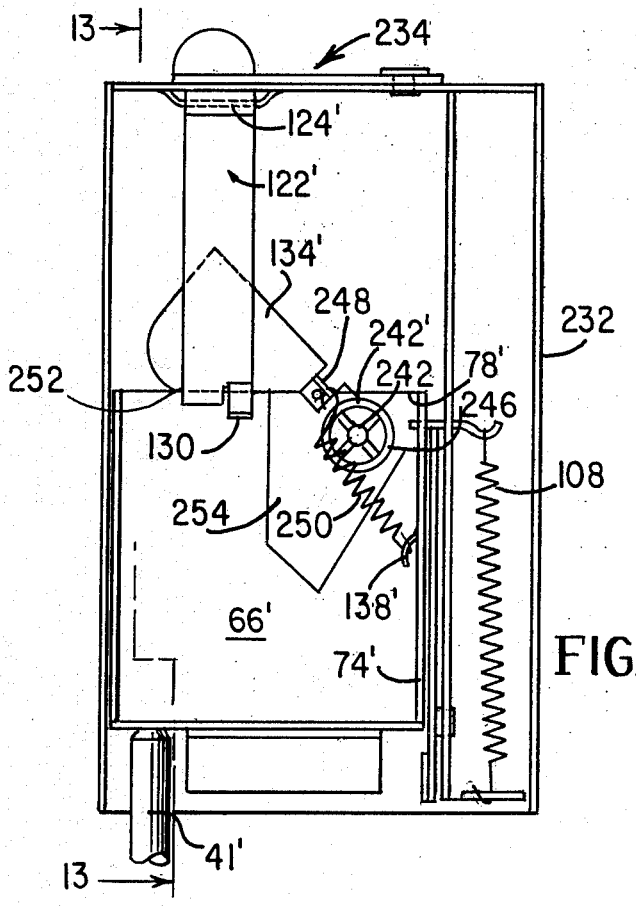
FIG. 12 is a plan view of a portion of the cover employed in the embodiment of FIG. 11, shown locked.
Figure 13:
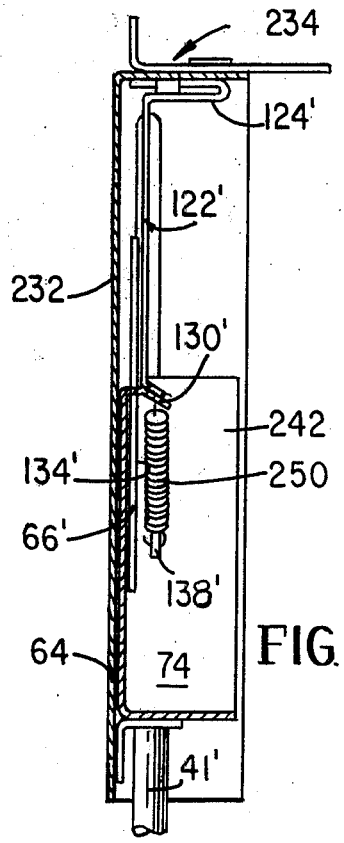
FIG. 13 is a longitudinal sectional view taken along line 13—13 of FIG. 12.

Referring now to FIGS. 11 to 13 inclusive, there is illustrated a slightly modified embodiment of the locked covered coin receptacle assembly according to the invention and designated generally by reference character 200. Assembly 200 is illustrated installed in a bracket structure 202 carrying funnel or chute 204 and a spring biased catch mechanism 206 installed in lieu of spring 68 for maintaining the locked cover-bag assembly 200 within the bracket 202.

The chute 204 may include, as shown, a row of perforations 208 provided to enable exterior viewing of the chute so that coin jams may be discovered and, when discovered, may be dislodged using an extended tapered rod or the like manipulated from the exterior of the machine through said perforations 208. The perforations 208 also permit installation of the bracket and chute in any of the conventional coin machines by providing means for connecting tabs thereto in different places depending on the machine concerned, thus universality of installation.

The spring catch mechanism 206 includes a slide 210 having a cammed free end 212 and an upstanding tab 214 at the opposite end carrying an aperture 216. A slide cover 218 permanently is secured to the wall 220 of bracket 202 and the slide 210 is slidably movable therein. A coil spring 222 is mounted between tab 224 formed of a portion of slide cover 218 and the tab 214, via aperture 216. A longitudinal slot 226 is formed in the wall 220 of channeled bracket 202 opening to the entry end thereof. The slide 210 is biased to place the end 212 across the slot 226. An upstanding tab 228 is formed on the bag-carrying portion 230 of the covered receptacle 200. The tab 228 is adapted to ride through slot 226 when the said assembly 200 is introduced into the bracket 202 through said entry end. The tab 228 thus engages the angled end 212, urging the slide 210 against its normal bias. Then the tab has been urged past the end 212, the slide 210 returns to its normally biased condition and prevents the reverse movement required for withdrawal of assembly 200 from bracket 202. In order to withdraw assembly 200, tab 214 is grasped and the slide 210 moved, also against its normal biased condition, to release the tab 228. The strength of the interior coil spring 108 within the cover portion of assembly 200 effectively causes the propulsion of the assembly 200 in locked condition from the bracket 202 when such release as described is effected.

Another difference between the assembly 200 and the assembly illustrated in FIGS. 1 to 10 is the provision of a pivotable latch member 234 at one end 236 of inner cover portion 232 cooperable with slot 238 formed in the outer cover portion 230. As described earlier, the cover portions 230 and 232 can be assembled and the latch 232 manipulated to place same through slot 238. Plastic seal 62 then can be applied through aperture 242 provided in said latch 232. The latch 232 functions also to provide a purchase which can facilitate handling of the inner cover portion 232 in separating same from the outer cover portion 230.

The principal remaining difference between the locking mechanism employed in the arrangement illustrated in FIGS. 1 to 10 and the mechanism employed with assembly 200 lies in the configuration and mounting of the shutter blade 134'. The upstanding bent formation 150 of the mechanism described as employed with the embodiment of FIGS. 1 to 10 is omitted. A post 242, in the form of a rivet fixedly is secured to slide member 66' adjacent its leading edge 78'. An aperture 244 is formed in the blade 134' of size diameter to receive the head 242' of said post so that the blade 134' is journalled thereon. A lockwasher 246 is applied to retain the assembly. Upset hook formation 138' is formed in the wall 74' of slide 66' and upset apertured tab formation 248 is formed on the blade 134'. Expansion coil spring 250 is secured across the tabs 138' and 248. Straight edges 252 and 254 are formed in blade 134', with the former acting against tab 132'.

Band spring 122' differs slightly from band spring 122 in that the formation 126 comprises a pair of oppositely directed bent tabs 130' and 132' formed at the free end of said spring 122' and functioning the same as formation 130 and 132 of spring 122.

The operation of the locking mechanism employed in assembly 200 is the same as that of the locking mechanism employed in the embodiment illustrated in FIGS. 1 to 10, except for the absence of the cammed portion 150 thereof.

It should be noted also that the provision of the formations 124 and 124' of the band springs 122 and 122' enables one easily to replace such spring by simple exchange rather than requiring major factory service, should the said spring be damaged.

It should be understood that reference to bent formation and band spring is equivalent to use of the terms latch, spring latch and catch, spring catch respectively.

What I claim is:

1. A cover assembly adapted to be locked onto a coin receptacle capable of being inserted into a preformed recess of a coin-controlled machine of the type that has an interior coin chute having a delivery end opening to the recess and including a top wall having a window alignable with said delivery end when the cover is engaged on the coin receptacle and together therewith is installed within the recess, slide means seated for slidable movement within the cover to cover and uncover the window, first spring means secured to the cover and to the slide means for biasing the slide means to a condition whereat the window is covered and second spring means arranged within said cover and operable upon said slide means to permit movement thereat upon one condition and prevent said movement upon a second condition; said second spring means comprising a generally flat spring having a first formation at one end thereof securable to said cover and a free opposite end arranged biased thereagainst, a catch formation on said free end, said catch formation being ridable upon said slide means during movement thereof, spring biased shutter blade means interposed between said catch formation and said slide means, said shutter blade means being mounted for movement with said slide means during uncovering of said window and for pivotal movement against its bias during return movement of said slide means, said blade means capable of being intercepted by said catch formation during return movement of said slide means to effect said pivotal movement whereby to bias said catch formation against said slide means, to prevent further movement thereat and detent means within said cover and operable with movement of said slide means, said detent means being disposed normally away from said window, said slide means operable to drive said detent means positively into said window when said slide means is manipulated against the bias of said first spring means partially or fully to uncover said window to prevent withdrawal of the covered coin-receptacle except when the window is fully covered.

2. The structure as claimed in claim 1 in which said shutter means is releasable upon lifting of said catch formation above the edge of said slide means whereby to permit movement of said slide means and said shutter means when the window is uncovered during installation.

3. The structure as claimed in claim 1 wherein said first formation comprises a clip formation and means on the cover cooperable with said clip formation for removably mounting said second spring means to said cover.

4. The structure as claimed in claim 1 in which said slide means includes notch means formed therein, said catch formation being aligned with said notch means whereby to engage therein upon return of said slide means covering said window.

5. The structure as claimed in claim 5 in which said catch formation is liftable from said notch means to effect resetting said cover assembly for installation, said shutter blade means returning to a condition interposed between said catch formation and said slide means.

6. The cover assembly as claimed in claim 1 and wherein said coin receptacle comprises a flexible coin receiving bag, a channeled plate having a rear wall, means securing said bag to said wall, a pair of flanged side walls and an open end, said cover being slidable through the open end of said plate to engage the rear wall thereof and said channeled plate having an opening formed therein adapted to be aligned with said window when the cover is installed therein, means securing said coin bag over the opening in said channeled plate and means secured to said slide means for driving same against the bias of said first spring means.

7. The cover assembly as claimed in claim 6 wherein swivel coupling means are provided to secure said bag to said channeled plate.

8. The cover assembly as claimed in claim 6 and means on one of said channeled plate and cover to retain same in assembly while said window is uncovered.

9. The cover assembly as claimed in claim 6 and spring biased latch means on one of said channeled plate and cover to retain same in assembly while said window is uncovered.

10. The cover assembly as claimed in claim 6 and pusher means installed within said recess, said pusher means arranged to pass through the opening in the rear wall of the plate and engage said driving means to uncover said window as the cover assembly is introduced into said recess.

11. The structure as claimed in claim 1 in which said shutter means has cam means along one edge thereof whereby to permit said catch formation to ride thereover during uncovering of the window.

12. The cover assembly as claimed in claim 9 wherein swivel coupling means are provided to secure said bag to said channeled plate.

13. The cover assembly as claimed in claim 1 in which said detent means comprise cam means effective to withdraw said detent from said window when the window is covered by said slide means.

14. The cover assembly as claimed in claim 1 in which said detent means comprises an elongate arm pivotally coupled to said slide means, said arm having a prong formation at the terminal end thereof and means biasing said prong away from said window during normal condition of said slide means, manipulation of said slide means against its normal bias of said first spring means serving to drive said prong formation into the window to assume an interferent condition relative to removal of said cover assembly from the recess whenever the window is uncovered.

15. The cover assembly as claimed in claim 1 wherein a coin funnel is secured interior of said enclosure and in communication with the delivery end of the coin chute, said coin funnel having a bottom opening, a channeled member secured to said funnel in communication with said bottom opening, said channeled member having a rear end wall and having means defining a track therein for receiving said cover slidably therein, pusher means secured on said rear end wall interior of said channeled member and arranged to engage said driving means for said slide means to uncover the window when the window is aligned with said funnel opening.

16. The cover assembly as claimed in claim 1 and spring biased retainer means on said channeled member and cover releasably to lock the cover within said channeled member.

* * * * *